US010900207B1

(12) United States Patent
Slaughter

(10) Patent No.: US 10,900,207 B1
(45) Date of Patent: Jan. 26, 2021

(54) THERAPEUTIC SHOWERING SYSTEM

(71) Applicant: James J. Slaughter, Seminole, FL (US)

(72) Inventor: James J. Slaughter, Seminole, FL (US)

(73) Assignee: Charmaine M. Slaughter, Seminole, FL (US)

( * ) Notice: Subject to any disclaimer, the term of this patent is extended or adjusted under 35 U.S.C. 154(b) by 70 days.

(21) Appl. No.: 16/172,744

(22) Filed: Oct. 27, 2018

Related U.S. Application Data

(63) Continuation-in-part of application No. 15/679,317, filed on Aug. 17, 2017, now abandoned.

(60) Provisional application No. 62/377,020, filed on Aug. 19, 2016.

(51) Int. Cl.
*E03C 1/046* (2006.01)
*B05B 7/24* (2006.01)
*B05B 1/18* (2006.01)

(52) U.S. Cl.
CPC ..... *E03C 1/046* (2013.01); *B05B 1/185* (2013.01); *B05B 7/2443* (2013.01)

(58) Field of Classification Search
CPC ..... B05B 7/2443; E03C 1/046
USPC ..... 4/615–618
See application file for complete search history.

(56) References Cited

U.S. PATENT DOCUMENTS 1,945,701 A * 2/1934 Pearl ..... B05B 7/2462 239/312
2,975,980 A * 3/1961 Siebert ..... B05B 1/18 239/316
2002/0070293 A1* 6/2002 Ti ..... E03C 1/046 239/317

* cited by examiner

*Primary Examiner* — Christine J Skubinna

(57) ABSTRACT

A shower head has upper and lower ends and a side wall in a frusto-conical configuration. An intermediate plate with a plurality of apertures is positioned between the upper and lower ends forming upper and lower chambers. A positioning ball has a lower portion within the upper chamber and an upper portion above the upper chamber. A hole is in the lower portion of the positioning ball. A cartridge supporting a quantity of therapeutic liquid is removably received in the lower chamber of the shower head. The therapeutic liquid is dispensed from the cartridge into a path of travel of shower water flowing through the shower head.

4 Claims, 7 Drawing Sheets

FIG. 3
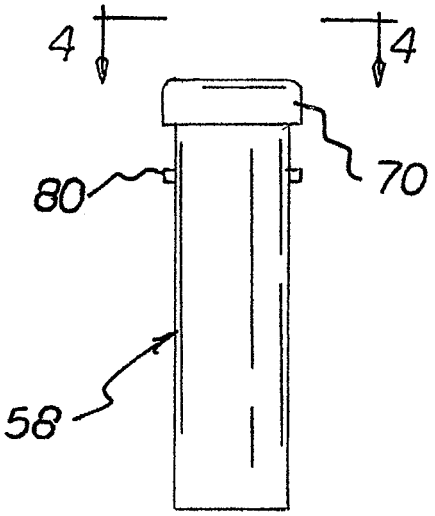
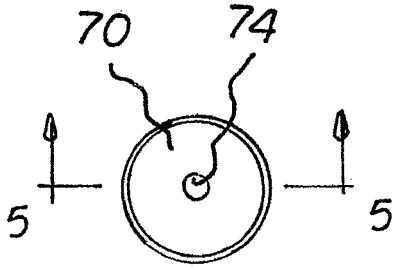
FIG. 4
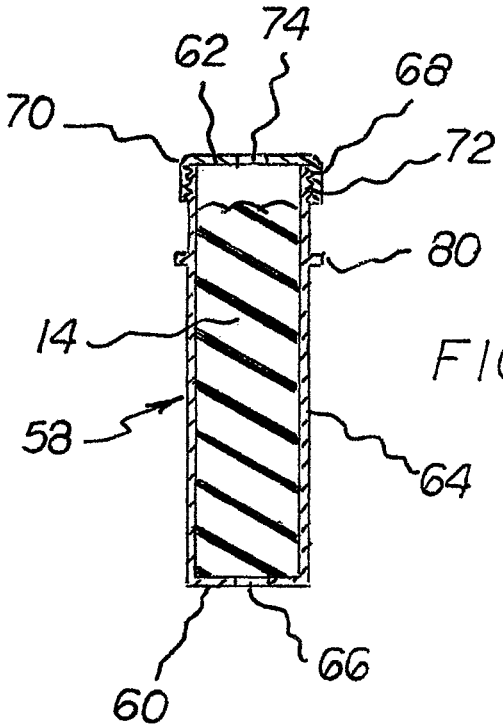
FIG. 5

FIG. 6
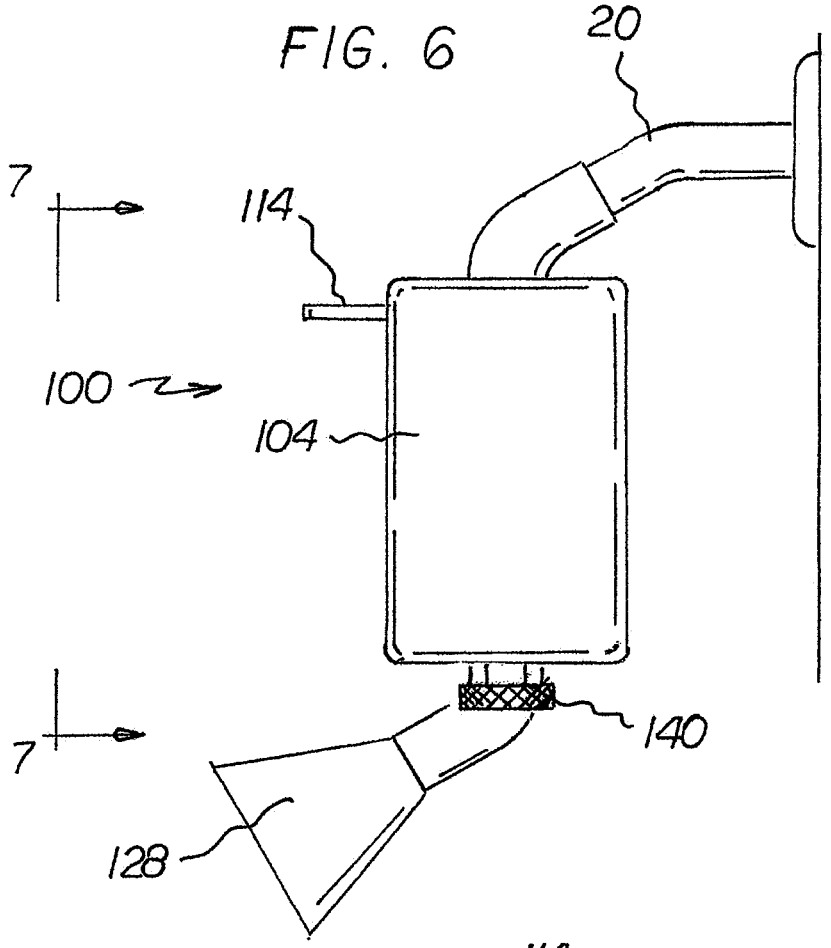
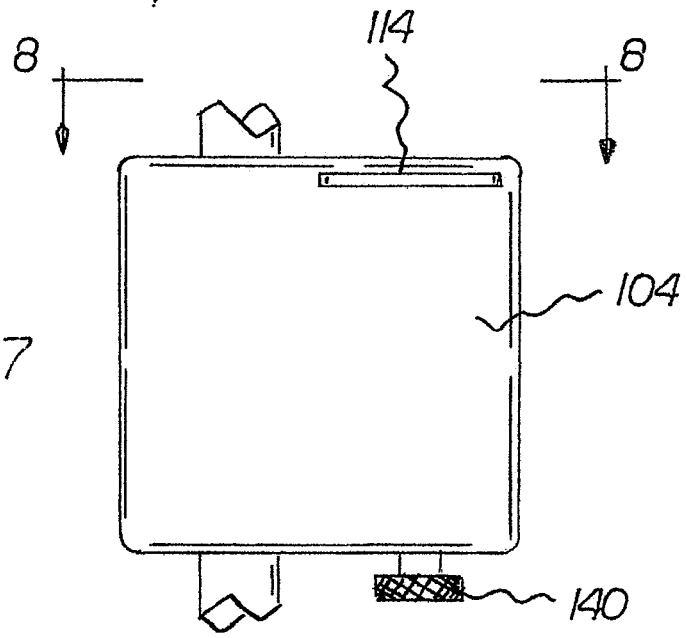
FIG. 7

FIG. 8
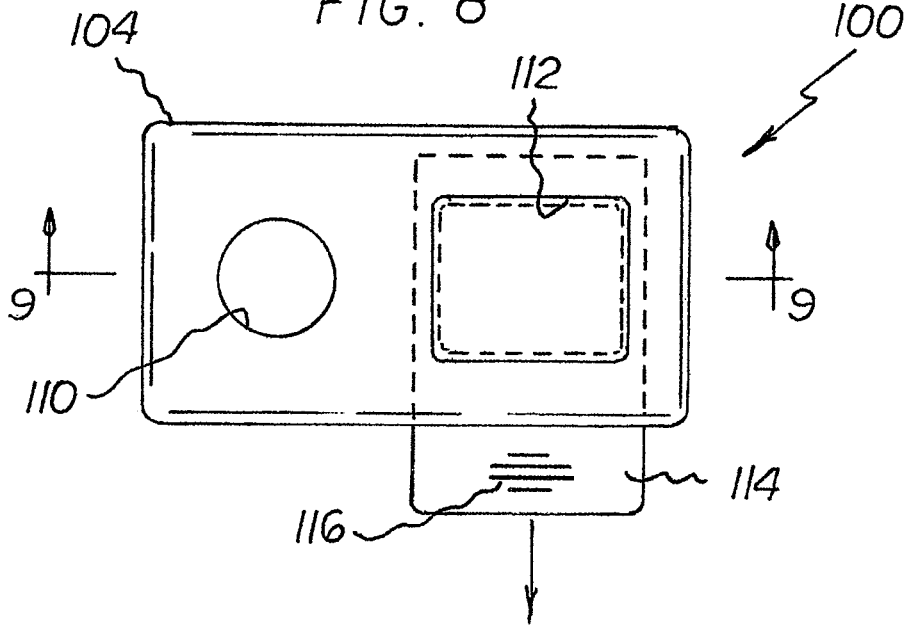
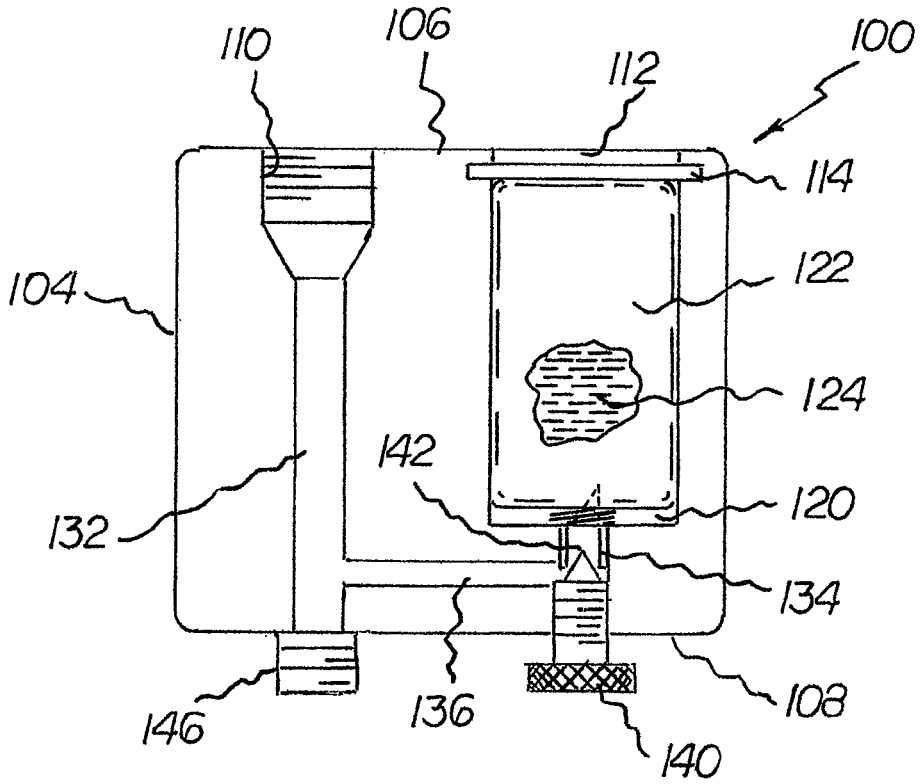
FIG. 9

THERAPEUTIC SHOWERING SYSTEM

RELATED APPLICATIONS

The present application is a continuation-in-part of pending application Ser. No. 15/679,317 filed Aug. 17, 2017 which, in turn, is based upon U.S. Provisional Application Ser. No. 62/377,020 filed Aug. 19, 2016, the subject matter of which applications is incorporated herein by reference and the priority of which is hereby claimed.

BACKGROUND OF THE INVENTION

Field of the Invention

The present invention relates to a therapeutic showering system and more particularly pertains to introducing a therapeutic substance into a flow of shower water for providing a healthful shower

DESCRIPTION OF THE PRIOR ART

The use of showers and like devices is known in the prior art. More specifically, showers and like devices previously devised and utilized for the purpose of cleaning oneself are known to consist basically of familiar, expected, and obvious structural configurations, notwithstanding the myriad of designs encompassed by the crowded prior art which has been developed for the fulfillment of countless objectives and requirements.

While these devices fulfill their respective, particular objectives and requirements, they do not describe a therapeutic showering system that allows introducing a therapeutic substance into a flow of shower water for providing a healthful shower.

In this respect, the therapeutic showering system according to the present invention substantially departs from the conventional concepts and designs of the prior art, and in doing so provides an apparatus primarily developed for the purpose of introducing a therapeutic substance into a flow of shower water for providing a healthful shower.

Therefore, it can be appreciated that there exists a continuing need for a new and improved therapeutic showering system which can be used for showers and like devices. In this regard, the present invention substantially fulfills this need.

SUMMARY OF THE INVENTION

In view of the disadvantages inherent in the known types of showers and like devices now present in the prior art, the present invention provides an improved therapeutic showering system. As such, the general purpose of the present invention, which will be described subsequently in greater detail, is to provide a new and improved therapeutic showering system and method which has all the advantages of the prior art and none of the disadvantages.

To attain this, from a broad perspective, the present invention essentially comprises a shower head having upper and lower ends and a side wall in a frusto-conical configuration. An intermediate plate with a plurality of apertures is positioned between the upper and lower ends forming upper and lower chambers. A positioning ball has a lower portion within the upper chamber and an upper portion above the upper chamber. A hole is in the lower portion of the positioning ball. A cartridge supporting a quantity of therapeutic liquid is removably received in the lower chamber of the shower head. The therapeutic liquid is dispensed from the cartridge into a path of travel of shower water flowing through the shower head.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved therapeutic showering system which has all of the advantages of the prior art showers and like devices and none of the disadvantages.

It is another object of the present invention to provide a new and improved therapeutic showering system which may be easily and efficiently manufactured and marketed.

It is a further object of the present invention to provide a new and improved therapeutic showering system which is of durable and reliable constructions.

An even further object of the present invention is to provide a new and improved therapeutic showering system which is susceptible of a low cost of manufacture with regard to both materials and labor, and which accordingly is then susceptible of low prices of sale to the consuming public, thereby making such therapeutic showering system economically available to the buying public.

Lastly, it is an object of the present invention to provide a therapeutic showering system for showers and like devices for introducing a therapeutic substance into a flow of shower water for providing a healthful shower to a user in a safe, convenient, and economical manner.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a front elevational view of the cartridge employed in the shower head illustrated in FIGS. 1 and 2.

FIG. 4 is a plan view taken along line 4-4 of FIG. 3.

FIG. 5 is a cross sectional view taken along line 5-5 of FIG. 4.

FIG. 6 is a side elevational view of a therapeutic showering system constructed in accordance with an alternate embodiment of the invention.

FIG. 7 is a side elevational view taken along line 7-7 of FIG. 6.

FIG. 8 is a plan view taken along line 8-8 of FIG. 7.

FIG. 9 is a cross sectional view taken along line 9-9 of FIG. 8.

The same reference numerals refer to the same parts throughout the various Figures.

DESCRIPTION OF THE PREFERRED EMBODIMENT

Figure 1:
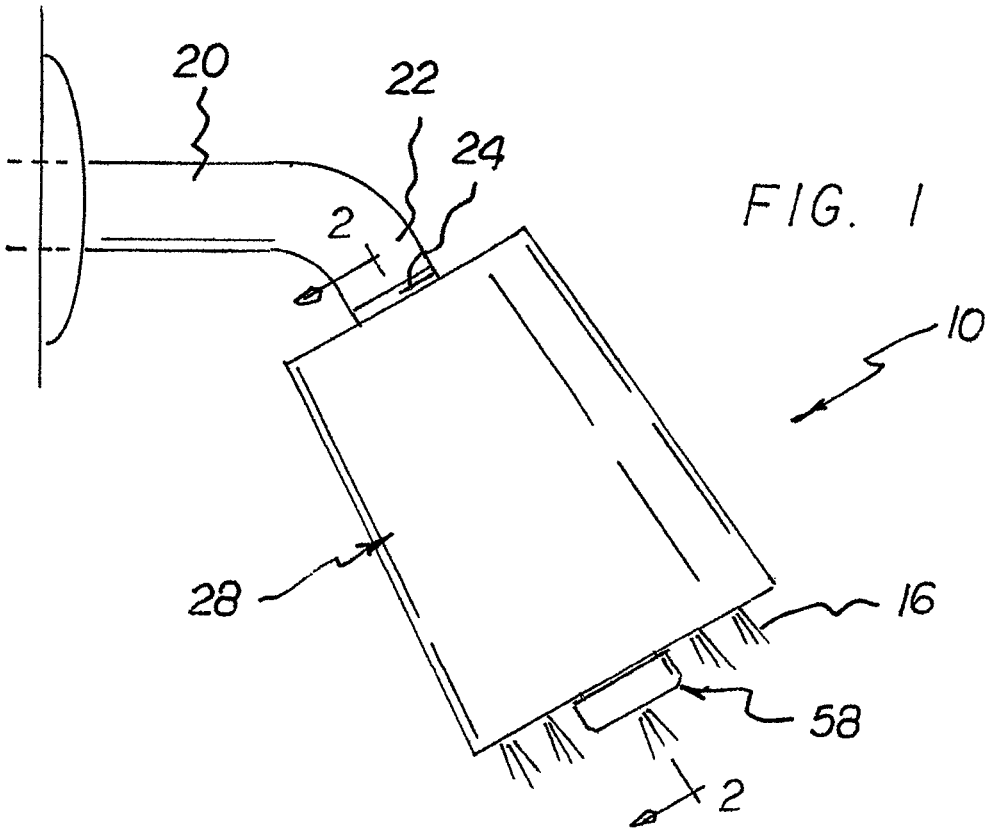
FIG. 1 is a side elevational view of a therapeutic showering system constructed in accordance with the principles of the present invention.
Figure 2:
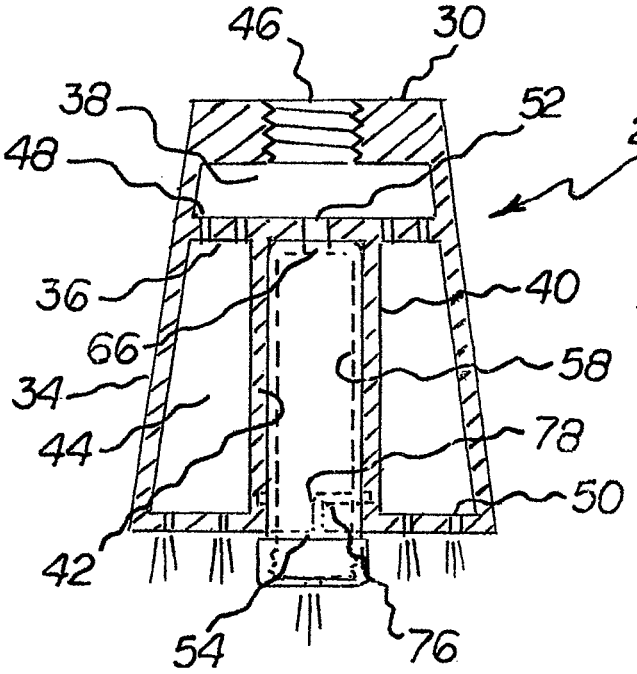
FIG. 2 is a cross sectional view taken along line 2-2 of FIG. 1.
Figure 10:
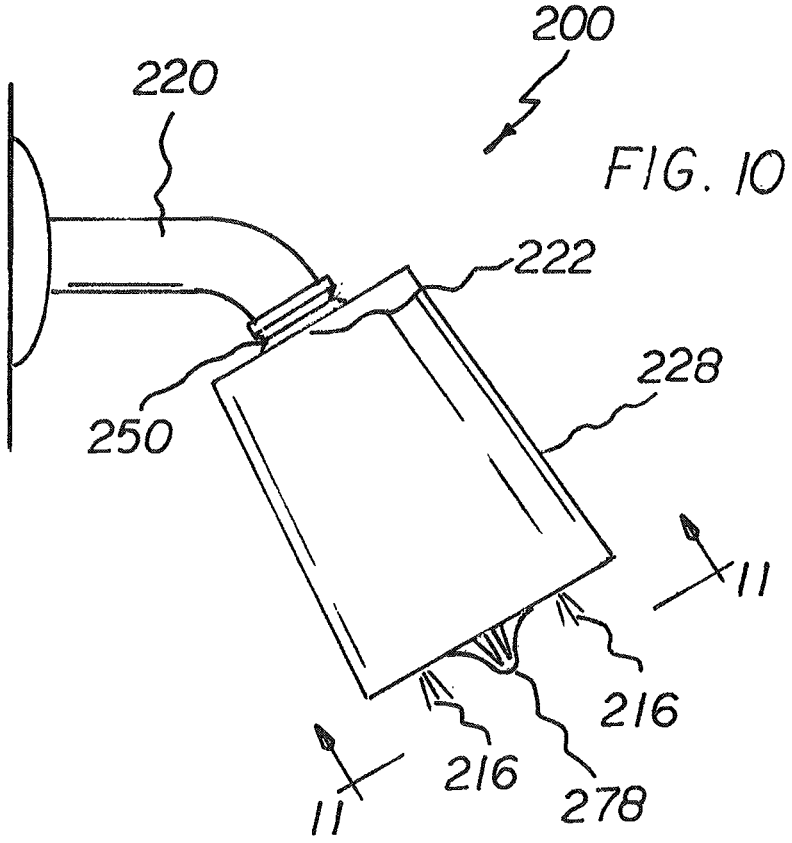
FIG. 10 is a side elevational view illustrating a therapeutic showering system constructed in accordance with the primary embodiment of the present invention.
Figure 11:
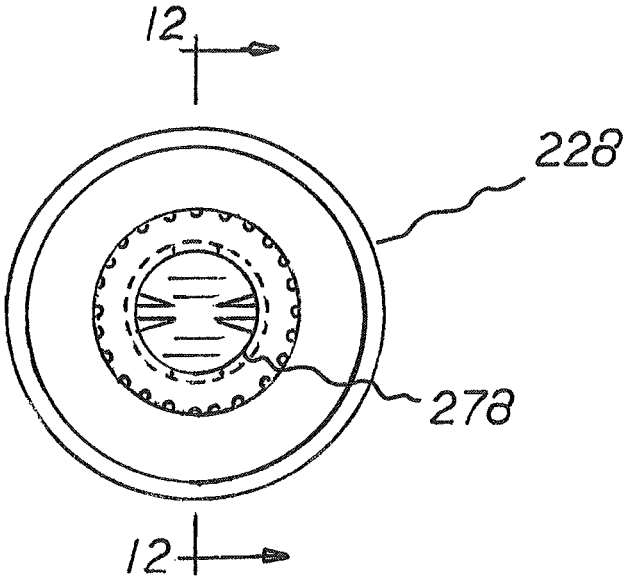
FIG. 11 is a bottom view taken along line 11-11 of FIG. 10.
Figure 12:
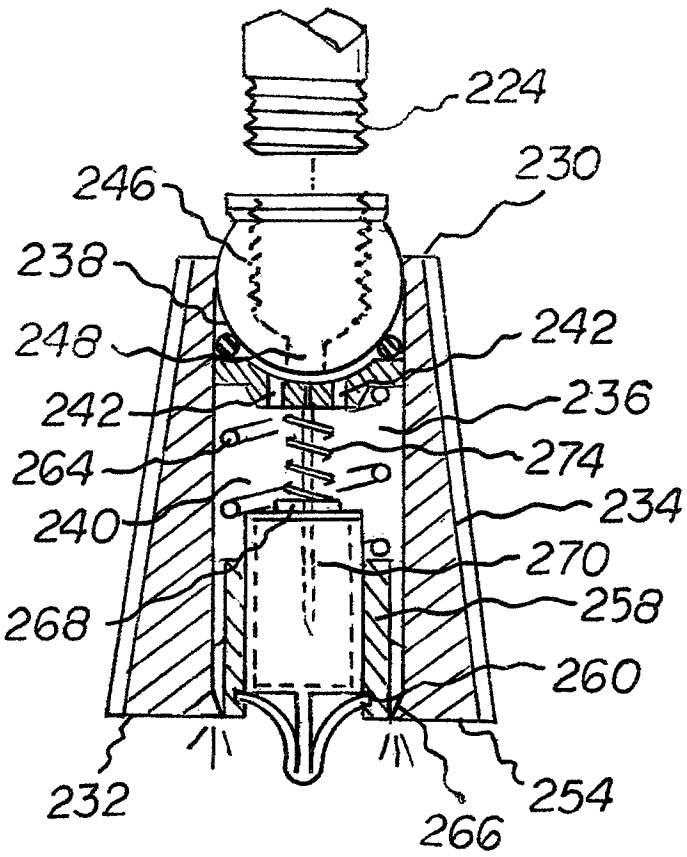
FIG. 12 is a cross sectional view taken along line 12-12 of FIG. 11.
Figure 13:
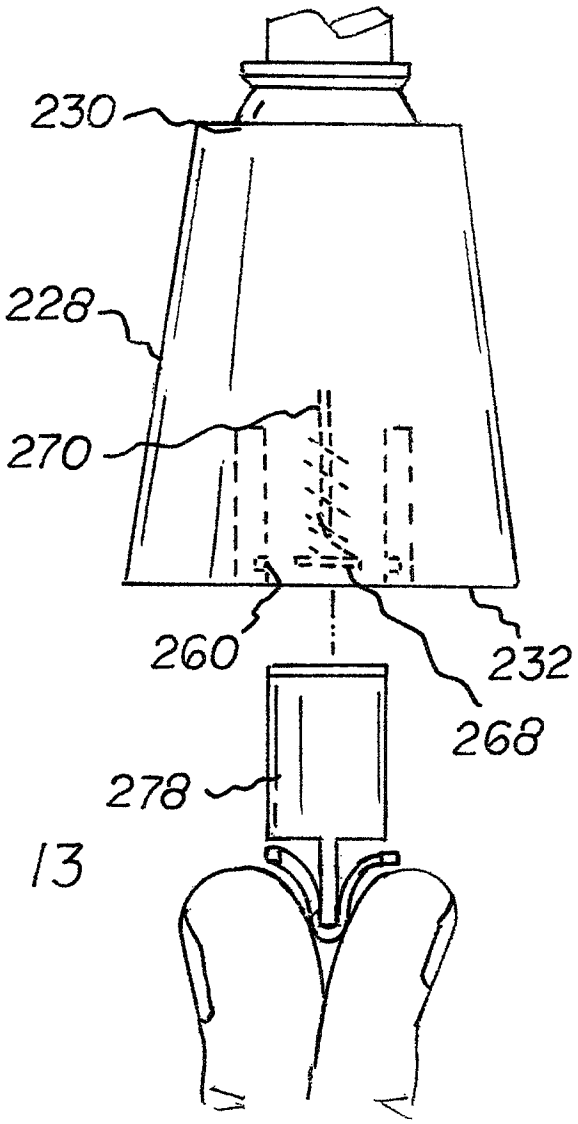
FIG. 13 is an exploded side elevational view of the canister illustrated in FIGS. 10-13.
Figure 14:
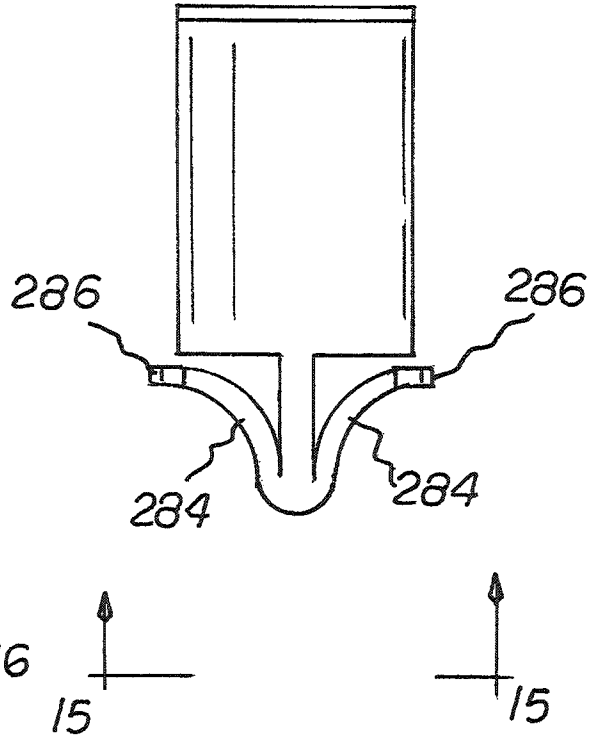
FIG. 14 is a side elevational view of the canister illustrated in FIGS. 10-13.
Figure 15:
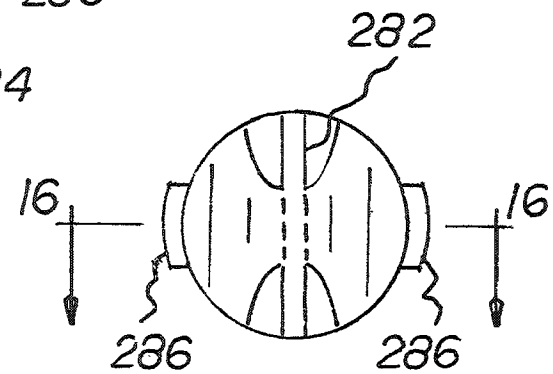
FIG. 15 is a bottom view taken along line 15-15 of FIG. 14.
Figure 16:
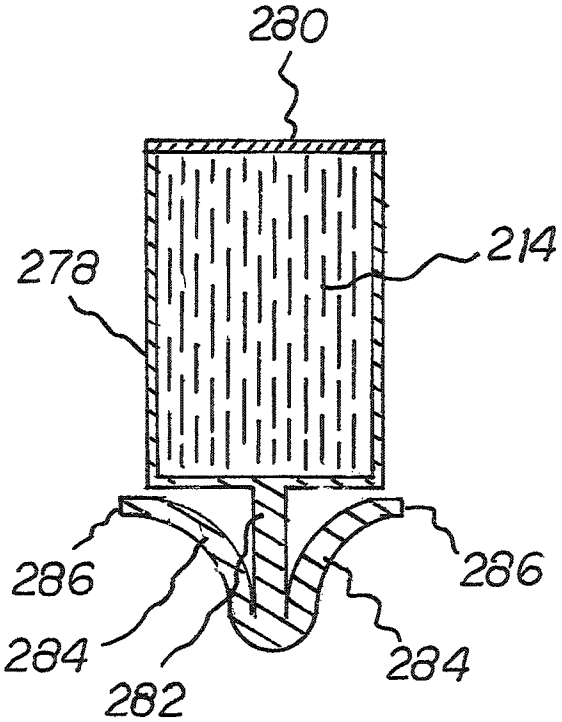
FIG. 16 is a cross sectional view taken along line 16-16 of FIG. 15.

With reference now to the drawings, and in particular to FIG. 1 thereof, the preferred embodiment of the new and improved therapeutic showering system embodying the principles and concepts of the present invention and generally designated by the reference numeral 10 will be described.

The present invention, the therapeutic showering system 10 is comprised of a plurality of components. Such components, in their broadest context, include a source of water and a shower assembly. Such components are individually configured and correlated with respect to each other so as to attain the desired objective.

From a specific standpoint, the invention is a therapeutic showering system 10 for introducing a therapeutic substance 14 into a flow of shower water 16 to provide a healthful shower to a user. The introducing and the providing are done in a safe, convenient, and economical manner.

The embodiment of the system 10 shown in FIGS. 1 through 5 comprises a water inlet line 20 with an end section 22 formed with male screw threads 24. The end section has a central axis extending downwardly and outwardly.

Next provided is a shower head 28 having an upper plate 30 in a circular configuration, a lower plate 32 in a circular configuration, and an intermediate plate 36. The shower head 28 has a side wall 34 in a frusto-conical configuration coupling the upper plate and the lower plate. The shower head has a central axis coextensive with the central axis of the end section of the water inlet line. The intermediate plate 36 is parallel with the upper plate and the lower plate. The intermediate plate is located closer to the upper plate than to the lower plate thereby forming an upper chamber 38 between the upper plate and the intermediate plate axially and the side wall radially. An intermediate wall 40 has a cylindrical configuration extending downwardly from the intermediate plate thereby forming a central chamber 42 in a cylindrical configuration and also forming an annular chamber 44 in a frusto-conical configuration between the intermediate plate and the lower plate. Female threads 46 formed in the upper plate are threadedly coupled to the male threads of the end section of the input line.

A flow assembly is formed of a plurality of holes 48, 50, 52, 54. The holes include a plurality of upper holes 48 in the upper plate coupling the upper chamber and the annular chamber. The holes also include a plurality of lower holes 50 in the lower plate coupling the annular chamber and exterior of the system. The holes also include an upper central hole 52 in the intermediate plate coupling the upper chamber and the central chamber. The holes also include a lower central hole 54 in the lower plate coupling the central chamber and exterior of the system.

The system also includes a cartridge 58 having a cylindrical configuration with a closed end 60 below, an open end 62 above, and a cylindrical wall 64 between the open end and the closed end. The closed end has a cartridge hole 66 axially aligned with the upper central hole 52 of the intermediate plate 36. The cartridge has an axial length greater than the length of the central chamber whereby a portion of the cartridge is exposed when the cartridge is inserted into the central chamber. Male screw threads 68 are formed in the cartridge adjacent to the open end. A cap 70 with female screw threads 72 is removably coupled to the male screw threads. A cap aperture 74 extends through the cap.

Provided next is a coupling assembly 76 which includes two slots 78 in the intermediate wall 40. The slots include a vertical section extending upwardly from the lower central hole 54 and a horizontal section extending circumferentially from the vertical section. The coupling assembly also includes pegs 80 axially aligned and extending outwardly and oppositely from the cartridge adjacent to the open end 62 for insertion into the slots 78 to removably couple the cartridge to the shower head.

Lastly, a quantity of therapeutic material 18 is provided in the cartridge. In this manner, a portion of the water passing through the system will become enriched by contact and coupling with the therapeutic material.

Another embodiment of the invention is shown in FIGS. 6 through 8. The therapeutic shower head system 100 is for introducing a therapeutic substance 124 into a flow of shower water to provide a healthful shower to a user. The system includes a water inlet line 120 with an end section formed with male screw threads.

A showering assembly is next provided. The showering assembly is formed of a housing 104 and a shower head 128. The housing has an input end 106 and an output end 108. The input end has female screw threads 110 for coupling to the male screw threads of the water inlet line. The input end has an enlarged opening 112. A reciprocable plate 114 with frictional ridges 116 is provided for opening and closing the enlarged opening. A chamber 120 is within the housing depending from the enlarged opening. An outlet is provided in the housing remote from the enlarged opening. A cartridge 122 of a supplemental substance 124 is in the chamber. The supplemental substance is chosen from the class of supplemental substances consisting of therapeutic substances and aromatic substances.

A plurality of lines are next provided within the housing. The plurality of lines include a water line 132, a therapeutic substance line 134, and a transfer line 136. The water line 132 extends between the input end and the output end for the passage of water there through. The therapeutic substance line 134 is parallel with the water line extending between the chamber and the output end. The transfer line 136 extends between the therapeutic substance line and the water line. An operational bolt 140 is threadedly received in the therapeutic substance line. The operational bolt has an operator controlled end exteriorly and a pointed end 142 interiorly. The pointed end is adapted to pierce the cartridge and adapted to vary the rate of flow of the therapeutic substance to the water line during use.

Lastly in this embodiment, male screw threads 146 depend from the output end adjacent to the water line for receiving the shower head.

Note is taken that one embodiment illustrates the input end above and the output end below with the water line extending vertically. It should be understood, however, that the system is operable with the housing turned at an angle with the water line horizontal or at any angle other than vertical or horizontal.

Note is also taken that another embodiment of the invention relies upon a venturi vacuum to introduce the supplemental fluid into the flow of water whereas in the first described embodiment, the supplemental substance is dispensed by water simply passing through the cartridge.

The preferred embodiment of the invention is shown in FIGS. 10 through 16. The therapeutic showering system 200 is for introducing a therapeutic substance 214 into a flow of shower water 216 for providing a healthful shower to a user. The introducing and the providing are done in a safe, convenient, and economical manner.

First provided in the preferred embodiment is a water inlet line 220 with an end section 222 formed with male screw threads 224. The end section has a central axis extending downwardly and outwardly.

Next provided is a shower head 228 having an upper end 230 in a circular configuration. The shower head also has a lower end 232 in a circular configuration. The shower head 228 has a side wall 234 in a frusto-conical configuration coupling the upper end and the lower end. The shower head has a central axis coextensive with the central axis of the end section of the water inlet line. An intermediate plate 236 is provided parallel with the upper end and the lower end. The intermediate plate is fixedly positioned closer to the upper plate than to the lower plate thereby forming an upper chamber 238 axially between the upper end and the intermediate plate. The upper chamber is radially within the side wall. The intermediate plate thereby also forms a lower chamber 240 axially between the lower end and the intermediate plate. The lower chamber is radially within the side wall. A plurality of apertures 242 are provided in the intermediate plate.

Next provided is a positioning ball 246. The positioning ball has a lower portion within the upper chamber whereby the shower head may be repositioned with respect to the water inlet line. The positioning ball has an upper portion above the upper chamber. A hole 248 is provided in the lower portion of the positioning ball. Female screw threads 250 in the upper portion are removably coupled to the male screw threads of the inlet line whereby a path of travel of shower water extends through the water inlet line, positioning ball, fixed plate, the lower chamber, and then out of the shower head.

Next, a primary sleeve 254 is provided. The primary sleeve is within the shower head extending between the upper end and the lower end. The primary sleeve has a frusto-conical exterior surface coupled to the shower head. The primary sleeve has a cylindrical interior surface terminating below with a plurality of rotationally spaced, inwardly extending abutment stops.

Next, a secondary sleeve 258 is provided. The secondary sleeve is within the shower head extending between the upper end and the lower end. The secondary sleeve has a cylindrical exterior surface spaced interiorly from to the primary sleeve to create a cylindrical water flow path. The secondary sleeve has a cylindrical interior surface. The secondary sleeve extends upwardly from the lower end of the shower head to an intermediate elevation of the lower chamber. An annular recess 260 is formed in the interior surface of the secondary sleeve adjacent to the lower end of the shower head.

An exterior coil spring 264 is next provided. The exterior coil spring is positioned between the intermediate plate and the secondary sleeve urging the secondary sleeve against the plurality of rotationally spaced, inwardly extending abutment stops of the primary sleeve.

Next, pressure plate 268 is provided. The pressure plate is slidable vertically within the secondary sleeve. A pin 270 extends downwardly from the intermediate plate. The pin has a tubular configuration with an open upper end aligned with a central aperture in the intermediate plate.

An interior coil spring 274 is next provided. The interior coil spring is positioned between the intermediate plate and the pressure plate urging the pressure plate downwardly.

Lastly, a cartridge 278 is provided. The cartridge has a cylindrical configuration with an upper end fabricated of a foil 280 adapted to be pierced by the pin creating a passageway. In this manner water is injected into the cartridge through and around the pin forcing therapeutic substances upwardly through the passageway into the path of travel of shower water. The cartridge also has a spacer wall 282 depending downwardly from the cartridge. Fingers 284 extend upwardly and outwardly from the spacer wall exterior of the lower chamber. The fingers are formed with outwardly extending tips 286 removably received in the annular recess to secure the cartridge within the shower head for dispensing therapeutic substance from the cartridge into the path of travel of the shower water.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A therapeutic showering system comprising:

a shower head having upper and lower ends and a side wall in a frusto-conical configuration, an intermediate plate positioned between the upper and lower ends forming upper and lower chambers, a plurality of apertures in the intermediate plate;

a positioning ball having a lower portion within the upper chamber and an upper portion above the upper chamber, a hole in the lower portion of the positioning ball;

a cartridge supporting a quantity of therapeutic liquid, the cartridge being removably received in the lower chamber of the shower head, the therapeutic liquid adapted to be dispensed from the cartridge into a path of travel of shower water flowing through the shower head;

a primary sleeve within the shower head extending between the upper and lower ends, the primary sleeve having a frusto-conical exterior surface coupled to the shower head, the primary sleeve having a cylindrical interior surface terminating below with a plurality of rotationally spaced, inwardly extending abutment stops;

a secondary sleeve having a cylindrical exterior surface spaced interiorly from to the primary sleeve to create a cylindrical path of travel of shower water, the secondary sleeve having a cylindrical interior surface, the secondary sleeve extending upwardly from the lower end of the shower head to an intermediate elevation of the lower chamber, an annular recess formed in the interior surface of the secondary sleeve adjacent to the lower end of the shower head;

an exterior coil spring positioned between the intermediate plate and the secondary sleeve urging the secondary sleeve against the plurality of rotationally spaced, inwardly extending abutment stops of the primary sleeve; and an interior coil spring coupling the intermediate plate and the pressure plate urging the pressure plate downwardly and urging the cartridge from the shower head.

2. The system as set forth in claim 1, wherein the cartridge is cylindrical with a foil upper surface, and further including a pin depending downwardly from the intermediate plate adapted to pierce the foil when the cartridge is introduced into the lower chamber.

3. A therapeutic showering system for introducing a therapeutic substance into a flow of shower water for providing a healthful shower to a user, the system comprising, in combination:

a water inlet line with an end section formed with male screw threads, the end section having a central axis extending downwardly and outwardly;

a shower head having an upper end in a circular configuration, the shower head having a lower end in a circular configuration, the shower head having a side wall in a frusto-conical configuration coupling the upper end and the lower end, the shower head having a central axis coextensive with the central axis of the end section of the water inlet line, an intermediate plate parallel with the upper end and the lower end, the intermediate plate being fixedly positioned closer to the upper plate than to the lower plate thereby forming an upper chamber axially between the upper end and the intermediate plate, the upper chamber being radially within the side wall, and thereby forming a lower chamber axially between the lower end and the intermediate plate, the lower chamber being radially within the side wall, a plurality of apertures in the intermediate plate;

a positioning ball having a lower portion within the upper chamber whereby the shower head may be repositioned with respect to the water inlet line, the positioning ball having an upper portion above the upper chamber, a hole in the lower portion of the positioning ball, female screw threads in the upper portion removably coupled to the male screw threads of the inlet line whereby a path of travel of shower water extends through the water inlet line, positioning ball, fixed plate, the lower chamber, and then out of the shower head;

a primary sleeve within the shower head extending between the upper end and the lower end, the primary sleeve having a frusto-conical exterior surface coupled to the shower head, the primary sleeve having a cylindrical interior surface terminating below with a plurality of rotationally spaced, inwardly extending abutment stops;

a secondary sleeve within the shower head extending between the upper end and the lower end, the secondary sleeve having a cylindrical exterior surface spaced interiorly from to the primary sleeve to create a cylindrical water flow path, the secondary sleeve having a cylindrical interior surface, the secondary sleeve extending upwardly from the lower end of the shower head to an intermediate elevation of the lower chamber, an annular recess formed in the interior surface of the secondary sleeve adjacent to the lower end of the shower head; an exterior coil spring positioned between the intermediate plate and the secondary sleeve urging the secondary sleeve against the plurality of rotationally spaced, inwardly extending abutment stops of the primary sleeve;

a pressure plate slidable vertically within the secondary sleeve, a pin extending downwardly from the intermediate plate, the pin having a tubular configuration with an open upper end aligned with a central aperture in the intermediate plate;

an interior coil spring positioned between the intermediate plate and the pressure plate urging the pressure plate downwardly; and a cartridge having a cylindrical configuration with an upper end fabricated of a foil adapted to be pierced by the pin creating a passageway whereby water is adapted to be injected into the cartridge through and around the pin forcing therapeutic substances upwardly through the passageway into the path of travel of shower water, the cartridge also having a spacer wall depending downwardly from the cartridge, fingers extending upwardly and outwardly from the spacer wall exterior of the lower chamber, the fingers being formed with outwardly extending tips removably received in the recess to secure the cartridge within the shower head for dispensing therapeutic substance from the cartridge into the path of travel of shower water.

4. A therapeutic showering system for introducing a therapeutic substance into a flow of shower water for providing a healthful shower to a user, the system comprising, in combination:

a shower head having an upper end, the shower head having a lower end, the shower head having a side wall coupling the upper end and the lower end, an intermediate plate positioned between the upper and lower ends forming upper and lower chambers, the upper chamber being radially within the side wall, and thereby forming a lower chamber axially between the lower end and the intermediate plate, the lower chamber being radially within the side wall, a plurality of apertures in the intermediate plate;

a primary sleeve within the shower head extending between the upper end and the lower end, the primary sleeve having an exterior surface coupled to the shower head, the primary sleeve having an interior surface terminating below with a plurality of spaced abutment stops;

a secondary sleeve within the shower head extending between the upper end and the lower end, the secondary sleeve having an exterior surface spaced interiorly from the primary sleeve to create a water flow path therebetween, the secondary sleeve having an interior surface, the secondary sleeve extending upwardly from the lower end of the shower head to an intermediate elevation of the lower chamber, an annular recess formed in the interior surface of the secondary sleeve adjacent to the lower end of the shower head;

an exterior coil spring positioned between the intermediate plate and the secondary sleeve urging the secondary sleeve against the plurality of abutment stops of the primary sleeve;

a pressure plate slidable within the secondary sleeve;

a pin extending downwardly from the intermediate plate, the pin having a tubular configuration with an open upper end aligned with a central aperture in the intermediate plate;

an interior coil spring positioned between the intermediate plate and the pressure plate urging the pressure plate downwardly; and a cartridge having an upper end open end that is sealed by a foil covering that is adapted to be pierced by the pin, thereby creating a passageway whereby water is injected into the cartridge through and around the pin forcing therapeutic substances contained within the cartridge upwardly through the passageway into the path of travel of shower water, the cartridge also having a spacer wall depending downwardly from the cartridge, fingers extending upwardly and outwardly from the spacer wall exterior of the lower chamber, the fingers being formed with outwardly extending tips removably received in the recess to secure the cartridge within the shower head for dispensing therapeutic substance from the cartridge into the path of travel of shower water.

* * * * *